United States Patent [19]

Peters

[11] Patent Number: 4,625,339

[45] Date of Patent: Dec. 2, 1986

[54] ILLUMINATING GLOVE

[76] Inventor: Raymond A. Peters, 473 W. 158th St., New York, N.Y. 10032

[21] Appl. No.: 785,013

[22] Filed: Oct. 7, 1985

[51] Int. Cl.[4] ..... A41D 19/00

[52] U.S. Cl. ..... 2/160

[58] Field of Search ..... 2/160, 249, 250; 362/103, 105; 224/217, 218, 222

[56] References Cited

U.S. PATENT DOCUMENTS 1,621,826 3/1927 Burtchaell ..... 2/250

3,638,011 1/1972 Bain et al. ..... 2/160

FOREIGN PATENT DOCUMENTS 688564 3/1965 Italy ..... 362/103

*Primary Examiner*—Doris L. Troutman

*Attorney, Agent, or Firm*—Howard M. Schwinger

[57] ABSTRACT

A glove having an elastic sleeve mounted on its upper side, the sleeve for holding a flashlight, the flashlight including a flexible mounting clip, the sleeve having a panel in its wall to support the mounting clip.

1 Claim, 2 Drawing Figures

ILLUMINATING GLOVE

This invention relates to gloves and more particularly to a glove adapted to carry a flashlight. The advantages of such a combination as a work aid are obvious.

Although there have been prior proposals for such a combination, these proposals have been deficient in one respect or another, particularly with respect to holding the flashlight in place on the glove.

It is thus a primary object of the present invention to provide a glove having means for securely holding a flashlight in place thereon.

Figure 1:
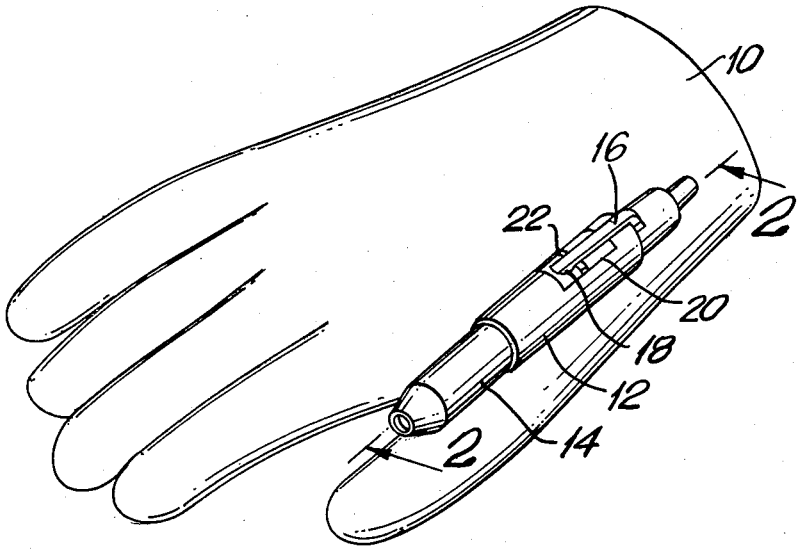
Figure 2:
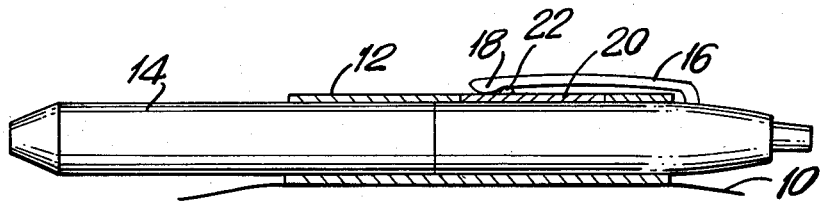

Other objects and advantages of the present invention will become apparent from a reading of the following detailed description and drawing wherein:

FIG. 1 is a perspective view of an embodiment of my glove flashlight combination, and FIG. 2 is a sectional view taken on line 2—2 of FIG. 1 in the direction of the arrows.

In the embodiment shown in FIG. 1, glove 10 is provided with sleeve 12 on its upper side in the vicinity of thumb and index finger. The sleeve is elastisized to securely hold a flashlight 14 inserted therein. The flashlight should be of the pen light type, i e, having a casing resembling that of a ball point pen.

The sleeve is preferably positioned so the light will extend outwardly between the thumb and index finger to best illuminate the work. The pen light includes the usual flexible clip 16 having an enlarged clamping tip 18.

A panel 20 is provided in the wall of sleeve 12. The panel may be of metal or plastic so as to provide a firm clamping surface for clip 16. An abutment 22 runs transversely of panel 20 to provide means for engaging clamping tip 18 to insure that the pen light will not work its way out of the sleeve. It will be realized that the light can only be released from the sleeve by a strong rearward pull thereon.

Although only a single embodiment of the invention has been shown it will be realized that modifications may be made which will fall both within the spirit as well as the letter of what is claimed.

I claim:

1. A glove having an elastic sleeve mounted on its upper side, at the junction of thumb and index finger, a penlight mounted in said sleeve, said light including a flexible mounting clip having an enlarged clamping tip, said sleeve having a panel in its wall to support said mounting clip, said panel including a raised abutment running transversely of the sleeve for retaining engagment with the enlarged end of the mounting clip.

* * * * *